US009615705B2

(12) United States Patent
Fischer

(10) Patent No.: US 9,615,705 B2
(45) Date of Patent: Apr. 11, 2017

(54) LIQUID ASPIRATOR FOR DRAWING OFF AND SUCKING UP LIQUIDS

(71) Applicant: Leifheit AG, Nassau (DE)

(72) Inventor: Klaus-Jürgen Fischer, Holzappel (DE)

(73) Assignee: Leifheit AG, Nassau (DE)

( * ) Notice: Subject to any disclaimer, the term of this patent is extended or adjusted under 35 U.S.C. 154(b) by 11 days.

(21) Appl. No.: 14/685,182

(22) Filed: Apr. 13, 2015

(65) Prior Publication Data

US 2015/0208886 A1 Jul. 30, 2015

Related U.S. Application Data

(63) Continuation of application No. 14/122,860, filed as application No. PCT/EP2012/060067 on May 29, 2012, now Pat. No. 9,021,654.

(30) Foreign Application Priority Data

May 27, 2011 (DE) ..... 10 2011 050 697

(51) Int. Cl.
*A47L 9/28* (2006.01)
*A47L 7/00* (2006.01)
(Continued)

(52) U.S. Cl.
CPC ..... *A47L 7/0009* (2013.01); *A47L 1/05* (2013.01); *A47L 5/24* (2013.01); *A47L 7/0004* (2013.01);
(Continued)

(58) Field of Classification Search
CPC . A47L 9/2842; A47L 1/05; A47L 5/24; A47L 9/0626; A47L 9/28; A47L 11/4044; A47L 11/4011; A47L 11/4008
See application file for complete search history.

(56) References Cited

U.S. PATENT DOCUMENTS 3,477,087 A 11/1969 Robinson
4,380,845 A 4/1983 Miller et al.
(Continued)

FOREIGN PATENT DOCUMENTS

CN 202537394 U 11/2012
CN 103251348 A 8/2013
(Continued)

OTHER PUBLICATIONS

Extended Search Report issued Feb. 6, 2015 in EP Application No. 14183781.
(Continued)

*Primary Examiner* — David Redding
(74) *Attorney, Agent, or Firm* — Panitch Schwarze Belisario & Nadel LLP

(57) ABSTRACT

A liquid vacuuming device for drawing off and vacuuming up liquids may include a housing (1), an extractor device formed by at least one extracting lip (7) for extracting and collecting the liquid in front of at least one vacuum mouth (5), a vacuuming device that features a motor-driven vacuum subassembly and is able to vacuum an air/liquid flow mixed with the liquid to be vacuumed up along a flow pathway from the vacuum mouth (5) through an intake channel (4) into the housing (1), a separating device (13) for separating the liquid from the air and a tank for receiving the separated liquid. The device may further include an on/off function that turns on the motorized drive or increases the motor power when pressure is exerted upon the extracting lip (7) and turns off the motorized drive or reduces the motor power when the pressure decreases. Similar functionality may be implemented by an orientation switch.

16 Claims, 3 Drawing Sheets

(51) Int. Cl.

| | |
|---|---|
| ***A47L 1/05*** | (2006.01) |
| ***A47L 9/06*** | (2006.01) |
| ***A47L 11/40*** | (2006.01) |
| ***A47L 5/24*** | (2006.01) |

(52) U.S. Cl.
CPC ..... *A47L 7/0023* (2013.01); *A47L 7/0028* (2013.01); *A47L 9/0626* (2013.01); *A47L 11/4016* (2013.01); *A47L 11/4027* (2013.01); *A47L 11/4044* (2013.01)

(56) References Cited

U.S. PATENT DOCUMENTS

| | | | | |
|---|---|---|---|---|
| 4,831,685 | A | 5/1989 | Bosyj et al. | |
| 4,993,106 | A | 2/1991 | Hult et al. | |
| 5,099,545 | A | 3/1992 | Krasznai et al. | |
| 5,870,851 | A | 2/1999 | Shoemaker | |
| 9,021,654 | B2 | 5/2015 | Fischer | |
| 2002/0066153 | A1* | 6/2002 | Sclafani | A47L 7/0009 15/347 |
| 2006/0150362 | A1* | 7/2006 | Mitchell | A47L 11/305 15/320 |
| 2010/0050368 | A1 | 3/2010 | Curien | |
| 2011/0138554 | A1 | 6/2011 | Curien | |

FOREIGN PATENT DOCUMENTS

| | | | |
|---|---|---|---|
| DE | 102008004964 | B3 | 5/2009 |
| DE | 102008004965 | B3 | 5/2009 |
| DE | 102011050697 | A1 | 11/2012 |
| DE | 102012104102 | A1 | 5/2013 |
| EP | 0170720 | A2 | 2/1986 |
| WO | 9424920 | A1 | 11/1994 |
| WO | 2010018342 | A2 | 2/2010 |
| WO | 2014032712 | A1 | 3/2014 |

OTHER PUBLICATIONS

International Search Report and Written Opinion issued in PCT/EP2012/060067, mailed Sep. 3, 2012, with English Translation of Search Report and WrittenOpinion.
International Preliminary Report on Patentability issued in PCT/EP2012/060067, issue date Dec. 2, 2013.

* cited by examiner

LIQUID ASPIRATOR FOR DRAWING OFF AND SUCKING UP LIQUIDS

CROSS-REFERENCE TO RELATED APPLICATIONS

This application is a continuation of U.S. patent application Ser. No. 14/122,860, which is a U.S. national-stage application under 35 U.S.C. §371 of PCT International Application No. PCT/EP2012/060067, filed May 29, 2012, which claims priority to German Patent Application No. 102011050697.7, filed on May 27, 2011, which are incorporated by reference herein.

TECHNICAL FIELD

Various aspects of this application are directed to a liquid vacuuming device for drawing off and vacuuming up liquids, with

- a housing,
- an extractor device formed by at least one extracting lip for extracting and collecting the liquid in front of at least one vacuum mouth,
- a vacuuming device that features a motor-driven vacuum subassembly and is able to vacuum an air/liquid flow mixed with the liquid to be vacuumed up along a flow pathway from the vacuum mouth through an intake channel into the housing,
- a separating device for separating the liquid from the air, and with
- a tank for receiving the separated liquid and
- an exhaust air channel acted upon with a partial vacuum for discharging the air from the housing.

BACKGROUND

A liquid vacuuming device of the above-mentioned type is known from U.S. Pat. No. 4,831,685 A. This device is designed in the form of a wet and dry vacuum cleaner and features a tank, in which a flow deflection arrangement is provided that diverts the air/water mixture being taken in radially outward. The intake channel leads into the tank similar to a nozzle and the mixture of water and air being taken in is diverted in the direction of a plate-shaped baffle, from which it flows radially outward after being deflected. The exhaust air channel likewise protrudes into the tank and features an opening on the upper side, through which the air separated from the water respectively can flow or is vacuumed out of the tank.

Another liquid vacuuming device of this type for drawing off and vacuuming up liquids is known from DE 10 2008 004 964 B, as well as from DE 10 2008 004 965 B. These known devices feature a flow channel that leads from a front extracting lip to an air outlet in the rear region of the device. Liquid collected by the extracting lip is vacuumed into the device together with ambient air through a vacuum mouth, separated from the air in a separation chamber and fed to a tank.

In order to separate the liquid from the air, a separation device that essentially consists of a profile for deflecting the flow of the water/air mixture is provided in the separation chamber. Due to this deflection, the heavier water impinges on the profile and then drips off into a temporary storage such that it can drain into a tank when the device is suitably oriented. The air, in contrast, can follow the partial vacuum and is drawn into the exhaust air channel around the profile.

A similar device disclosed in US 2010/0050368 A likewise features a separate tank that is protected from a backflow of the liquid in an unfavorable position of the device by means of check valves.

SUMMARY OF VARIOUS EMBODIMENTS

According to one embodiment of the invention, a liquid vacuuming device may be designed with an on/off function such that the motorized drive of the vacuum subassembly is turned on or the motor power is increased when pressure is exerted upon the extracting lip and the motorized drive is turned off or the motor power is reduced when the pressure decreases. According to another embodiment of the invention, a liquid vacuuming device may be designed in which the on/off function is controlled by means of an orientation switch that detects the spatial orientation of the device.

According to the invention, the window cleaning device is provided with an on/off function that either turns off the motorized drive of the vacuum subassembly entirely or reduces the power in order to avoid excessively long restart times. In one potential embodiment, the on/off function is realized in such a way that the device is turned on or the motor power is increased when pressure is exerted upon the extracting lip. In this case, decreasing pressure can cause the device to be turned off or the power to be reduced.

In addition, a timer may be provided that the turns off or reduces the suction performance after a certain predetermined period of time. It would alternatively or additionally also be possible to provide an orientation switch that turns off or reduces the performance of the vacuum subassembly when the device is tilted or swung out of its upright position, in which the extracting lip is arranged on top. Since a suction effect may also or specifically be desired during lateral motions with a laterally positioned extracting lip, the orientation switch may be realized in such a way that it is only activated when the extracting lip points downward. A delay switch may delay the turn-off function such that a brief tilting motion does not affect the motor function.

The implementation of the pressure switch may be realized by mounting the extracting lip on the housing such that it can be slightly pivoted against the force of a return spring or the elasticity of the component itself, wherein the pivot bearing comprises a sensor that can detect a slight rearward pivoting motion of the extracting lip and convert this pivoting motion into a turn-on pulse. Similar to a stand-by circuit, this may be realized by means of a secondary circuit such that an initial pressure exerted upon the extracting lip activates the device altogether.

In another embodiment of the invention, the liquid is directly deflected into the tank. For this purpose, the tank and the separation space are combined with one another, i.e. the intake channel leads into the tank that forms the separation space with its central region.

In a potential embodiment, the intake channel leads into the tank with an exposed pipe nozzle. In this case, the flow of the liquid/air mixture exiting this pipe nozzle impinges on a separating device arranged at the outlet. The separating device is realized in the form of a baffle that deflects the flow radially outward into the tank. The separating device may be realized in a stationary or rotating fashion.

If a stationary separating device is used, it may be formed by a disk that becomes thinner from the inside toward the outside, wherein the contour, on which the flow impinges, follows a curved, outwardly directed flow line. This means that the separating device has the shape, for example, of a cone or a valve tappet. It preferably deflects the flow with a large deflection angle, but little resistance, so as to not impair the air flow and therefore minimize the energy consumption, as well as to largely optimize the separating function due to the changes in direction.

In a preferred embodiment, the exhaust air channel also protrudes into the tank with a pipe nozzle. It may alternatively also end flush with the tank wall. In any case, it should be provided with a means for preventing or at least suppressing water from being admitted into the exhaust air channel and from being ejected from the device together with the air flow.

The means for retaining the water preferably consists of a flow labyrinth. This flow labyrinth together with the separating device forms an effective protection against the admission of water without requiring special quiescent zones for the flow in addition to the tank. For example, a cap of sorts is attached onto the pipe nozzle protruding into the tank for this purpose, wherein said cap twice reverses the flow direction of the air flow. To this end, the cap may be closed on its front and extend along the pipe nozzle forming the exhaust air channel with a wall region, wherein an annular gap or other air passages remain between the pipe nozzle and the cap such that the air can initially flow forward again parallel to the nozzle axis through said annular gap or air passages until it reaches the front region of the cap in its interior, where the flow direction of the air flow is once again reversed and the air flow can ultimately enter the pipe nozzle.

The annular gap is preferably realized such that water admitted into the annular gap once again drains back into the tank when the device is held horizontally. For this purpose, the annular gap may be realized, for example, such that its diameter slightly widens in the direction of the end of the pipe nozzle. The pipe nozzle may also be provided with additional means for draining water, which was admitted therein despite all precautions. These means may consist of small drainage holes that return the water into the tank. A circumferential annular gap may also be provided in the exhaust air channel. In this case, potential air leakage flows can be accepted as long as a sufficiently large portion of air is vacuumed off.

Due to the described design of the liquid vacuuming device, the liquid/air mixture is drawn in by the vacuum mouth via the intake channel and diverted to the separating device due to the shape of the intake channel, if applicable with the aid of an additional flow guiding profile. Alternatively to a stationary baffle, the separating device may also be realized in the form of a rotor that acts as a dynamic separating device in this case.

Analogous to known liquid vacuuming devices, the device features in its front region an extracting lip and is preferably designed in the form of a single-hand device. For this purpose, the housing features a handle for holding the device such that it can be guided, for example, along a glass pane like a conventional window wiper and the liquid can be drawn off this window pane and simultaneously vacuumed up.

The vacuum mouth, which may be realized in the form of a broad slot nozzle, is arranged behind the extracting lip in the region, in which the liquid is collected. For example, one typical application of the invention is a window cleaning device, by means of which water for cleaning the window can be drawn off and vacuumed up. For this purpose, a sponge may also be arranged adjacent to the suction lip and brought in contact with the window instead of the extracting lip depending on the orientation of the device in order to initially wet-clean the window. In this case, it would also be possible to provide an additional liquid supply, by means of which a cleaning liquid can be pumped in front of the extracting lip or the sponge or even directly into the sponge in a manual or motor-driven fashion.

In an alternative embodiment of the invention, the extracting lip may also be realized in a bent or V-shaped fashion such that the liquid being drawn off is collected in the central region, where a differently shaped vacuum mouth, for example a vacuum mouth that acts at specific points, can vacuum up the liquid. This design is particularly advantageous for devices that feature a movable extracting lip and are intended, in particular, for floors or other horizontal surfaces.

A flow pathway leads from the vacuum mouth into the hollow chamber via the intake channel and from the hollow chamber to a rear outlet via the exhaust air channel, wherein the air separated from the liquid in the hollow chamber can once again exit the device through said rear outlet. The suction effect is produced by a rotor that generates a partial vacuum for driving the flow (in a manner not described in greater detail) as it is also the case with known liquid vacuuming devices. This rotor is driven by a motor, wherein the motor is preferably supplied with power by an accumulator or batteries in order to ensure that the device can be used independently of its location.

In this embodiment, the liquid/air flow is directly diverted into the tank and the water is separated when said flow enters the tank, as well as when it exits the tank. Due to this separation of the separating means into a front separating device and a rear splash protection, the liquid can be effectively separated from the air without requiring a temporary storage that requires much space. Instead, the available space can be used directly for the tank volume.

Another preferred embodiment of the invention features a separating device in the form of a moving rotor. In this case, the motor for driving the rotor that generates the suction pressure preferably also drives the separating device within the hollow chamber that is realized in the form of a front rotor. For this purpose, the driving motor is initially connected to the rotor wheel of the vacuum subassembly that is realized, for example, in a turbine-like fashion and sets this rotor wheel in rotation. Analogous to a conventional vacuum cleaner, this generates a partial vacuum such that air is conveyed through the housing via the intake channel, the hollow chamber and the exhaust air channel. This vacuum subassembly is then connected to the front rotor that acts as a separating device in this case via an additional drive shaft.

One essential characteristic of this partial aspect of the invention is the fact that the liquid/air mixture taken in via the intake channel no longer exclusively impinges on a separating baffle, but rather on the motor-driven rotor arranged in the hollow chamber. A region of this hollow chamber simultaneously forms the tank, as well as the separating chamber, within which the rotor ensures the separation of the liquid from the mixture.

In order to separate the liquid from the liquid/air flow being taken in, the rotor features at least one impact surface, at which the flow is directed. This impact surface usually does not come in direct contact with the flow, but rather causes a reversal of the air flow direction in the form of a flow obstacle whereas the heavier liquid particles of the flow impinge on the impact surface and are diverted in a different direction than the air due to their inertia. Consequently, the air essentially follows the vacuum and flows along the shortest flow pathway.

The liquid, in contrast, is not deflected as quickly due to its greater inertial forces and therefore describe a trajectory with greater radii. This on the one hand leads to the two mediums following different flow pathways and on the other hand to the liquid impinging on the sidewalls or on the rotor itself due to the larger flow radius required. The latter in turn causes the liquid to be separated from the air flow and to be collected in the annular hollow space that surrounds the intake channel, the separation chamber and the exhaust air channel.

Due to the fact that the impact surface now lies outside the intake channel, the rotor wheel can have a diameter that is significantly larger than the inside diameter of the intake channel. In order to ensure that the flow impinges on the impact surface, flow guiding profiles for deflecting the flow onto the impact surface may be arranged in the intake channel or a short distance behind the intake channel.

It is preferred to use a flow guiding profile that is realized, for example, in a bell-like or conical fashion, wherein the point is arranged in the intake channel and the rearwardly widening part deflects the flow outward. This flow then impinges on the annular impact surface in the outer region, wherein the liquid components are accelerated by the rotating rotor wheel and thrown into the outer region of the hollow chamber. Subsequently, they drain down from the inner outside wall, wherein the device is usually held in such an operating position that the extracting lip is on top and the separated liquid is located around the exhaust air channel.

The housing may consist of two parts such that either the hollow chamber together with the entire tank can be removed. For this purpose, the hollow chamber may be realized, for example, in the form of a separate component, e.g. a cylindrical component, that can be attached to the exhaust air channel or the air intake channel, wherein the parting plane of the housing lies in the region of the hollow chamber. The housing is preferably provided with a safety switch that respectively turns off the motor or prevents the motor from being turned on by interrupting the power supply when the housing is opened. The hollow chamber may alternatively also be formed by the housing itself such that the inner side of a section of the housing forms the outer side of the hollow chamber. In this case, two partition walls are provided in the housing, wherein one partition wall features a passageway for the intake channel and the other partition wall features a passageway for the exhaust air channel.

If the housing consists of two parts, it can be opened in order to be emptied or cleaned. For example, the intake channel may be provided on the front housing part and removed from the remaining housing together with the front housing part by being pulled out of the hollow chamber. O-ring seals may be used for sealing the intake channel such that it can on the one hand be pulled out together with the front housing part, but on the other hand also assembled in a tightly sealed fashion. When the front housing part is removed, the hollow chamber in the form of a hollow-cylindrical component can be removed from the exhaust air channel that in turn may once again be sealed with the aid of O-ring seals.

The above-described design makes it possible to disassemble and clean the housing and logically also the hollow chamber itself. For this purpose, the hollow chamber itself may consist of two parts such that it can be disassembled into two housing halves. The rotor forming the separating device may likewise be realized in a removable fashion such that this rotor can also be easily cleaned. If the cylindrical body forming the hollow chamber consists of two parts, these two parts naturally also need to be connected to one another by means of seals such that liquid can escape from the hollow chamber when the device lies horizontally.

One specific characteristic is the fact that the liquid contained in the liquid/air flow respectively is thrown outward by means of the rotor and separated from the air flow such that liquid can collect in the hollow space serving as the tank in order to be subsequently emptied out. Since the liquid vacuuming device will in most instances be realized in the form of a hand-held device that is also used in a transverse position or even overhead like a squeegee, it is important that the liquid cannot drain out again through the intake channel. This is the reason why the intake channel protrudes into the hollow space with a pipe nozzle such that the liquid also remains in the tank around this intake nozzle and does not drain out of the intake channel in an overhead position.

This applies analogously if the device is used in an upright position, i.e. when the vacuum lip is arranged on top. In this case, the nozzle of the discharge channel protrudes into the hollow space such that a hollow space, in which the liquid can be collected without being able to drain downward through the exhaust air channel, is once again formed around the nozzle of this discharge channel. In summary, the tank therefore is formed by a region of the hollow chamber, into which the intake channel and the exhaust air channel are respectively inserted from the top and from the bottom in a nozzle-like fashion, and the protruding nozzle-like channel ends ensure that the liquid separated from the air flow cannot escape again in all orientations of the device. This function can be improved if the respective cross section of the intake channel or the discharge channel slightly widens in the direction of the interior of the hollow chamber.

Several options basically are available for emptying the device. The hollow space forming the tank may be closed with a plug that releases a pathway to the outside. In this case, an emptying channel, through which the device can be emptied, is connected to the hollow space. On the other hand, the device may also be emptied with the aid of the above-described cleaning function realized by dividing the housing, as well as the hollow space, into two parts. In this case, the housing is simply disassembled in the above-described fashion and half of the hollow space is emptied after its disassembly.

A third option for emptying the device consists of arranging the intake channel and the exhaust air channel in the housing in a displaceable fashion such that one of the two channels can be respectively pulled out until its pipe nozzle no longer protrudes into the hollow space. For example, the device can in this way be positioned upside down and the intake channel that, for example, may be rigidly connected to the extracting lip can be pulled out toward the front. Since the pipe nozzle no longer protrudes into the hollow space after the intake channel has been pulled out, the flow resistance is eliminated and the liquid located in the hollow space can drain out.

Electrical contacts can ensure that the device is only able to commence its vacuuming function when the intake channel is in the correct position, i.e. in the inserted position. For this purpose, simple contacts may be provided on the intake channel in order to interrupt the motorized drive of the vacuum subassembly when the intake channel is pulled out. An emptying function could be realized in the same way with the exhaust air channel, wherein the liquid can then be emptied through the exhaust air channel after it has been pulled out.

The exhaust air channel, as well as the intake channel, may be provided with additional valve elements that can additionally seal off the exhaust air channel or the intake channel when liquid is on the verge of escaping due to an unfavorable rotation of the device.

It is advantageous that the intake channel originating at the extracting lip protrudes into the hollow space with its pipe nozzle whereas the exhaust air channel likewise protrudes into the hollow space on the opposite side. The rotor that acts as the separating device in this case is arranged in a gap formed between the two pipe nozzles. The liquid/air flow impinges on this rotor, wherein a gap provided between the intake channel and the rotor is on the one hand sufficiently small for maintaining the suction pressure and on the other hand sufficiently large for conveying the liquid/air flow through the device without major performance losses.

The rotating rotor conveys the liquid, which impinges on the rotor due to its inertia or is deflected by the rotor, into the outer region of the hollow space whereas the much less inert air is removed from the hollow space by the partial vacuum applied to the exhaust air channel by the vacuum subassembly. For example, the nozzle of the exhaust air channel protruding into the hollow space may, in principle, feature an air inlet opening over its circumference such that the air can be vacuumed out of the hollow space.

Another preferred embodiment, in contrast, features a rotor that is permeable in the center and arranged directly in front of the nozzle of the exhaust air channel protruding into the hollow space. In this embodiment, the drive shaft for the rotor extends through the exhaust air channel such that the rotor and the drive shaft are arranged concentric to the cylindrical drive channel. In order to ensure the separating function, a flow guiding profile may in this embodiment be provided in the intake channel in order to divert the flow from the intake channel outward. The rotor features a pipe nozzle that surrounds the opening for the inlet into the exhaust air channel and protrudes into the flow guiding profile that is realized in a bell-like or conical fashion in this case.

A small gap remains between this pipe nozzle on the rotor and the flow guiding profile, wherein the air can reach the exhaust air channel through this small gap after several reversals of its flow direction whereas the liquid impinges on the impact surface of the rotor or is conveyed into the hollow space by an outwardly directed airflow that is generated in the vicinity of the impact surface due to the motion of the rotor. It is ultimately irrelevant if a portion of the air is conveyed into the hollow space together with the liquid as long as the geometry of the exhaust air channel or the air inlet into the exhaust air channel ensures that air taken in through the intake channel is once again vacuumed off through the exhaust air channel without the liquid, with which it was taken in.

Another embodiment of the invention features an extracting lip that is realized in the form of a separate component together with the vacuum mouth and inserted into the device, wherein the vacuum mouth is connected to the intake channel by means of a sealed plug-type pipe connection. This design has the advantage that the functional unit formed by the extracting lip and the vacuum mouth can be completely removed and connected to the device via a hose. Consequently, this functional unit can be attached to a pole or a hose in order to create a lightweight extractor with vacuum function whereas the remaining device is either carried by an operator, for example, on a carrying strap or lies on the ground. In this case, the pole is provided with an intake channel or intake hose and can be connected to the device on one side and to the unit consisting of the extracting lip and the vacuum mouth on the other side such that the water in front of the vacuum mouth can be vacuumed up via the intake channel or intake hose.

The extracting lip may alternatively or additionally also be realized in a removable fashion. This makes it possible to use the extracting lip independently of the device when the vacuum function is not required.

The housing ultimately may also feature a receptacle for a pole, particularly on its rear side that lies opposite of the vacuum mouth. This receptacle preferably consists of a universal receptacle for poles of domestic appliances already present in the household. The pole, which may also be realized in the form of a telescopic pole, can be easily attached to the housing in this case. The reach of the user also can be easily increased in this way.

The extracting lip and optionally also the vacuum mouth may be rotatably or pivotably mounted on the housing, wherein this may be realized, for example, with a tightly scaled ball-and-socket joint arranged in the connection between the housing and the unit consisting of the extracting lip and the vacuum mouth. This ball-and-socket joint may be realized in such a way that the intake channel extends through the joint. The intake channel may alternatively also extend laterally past the joint in the form of a hose.

BRIEF DESCRIPTION OF THE DRAWINGS

The following description of a preferred exemplary embodiment is presented with reference to the drawings. In these drawings.

DETAILED DESCRIPTION OF VARIOUS EMBODIMENTS

Figure 1:
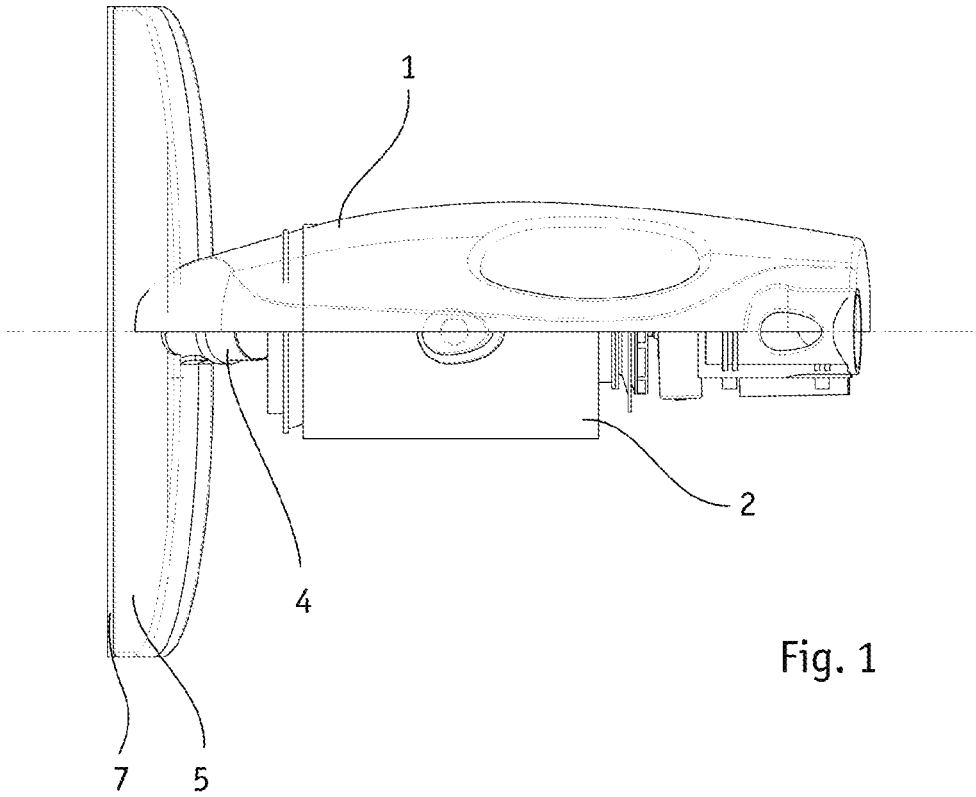
FIG. 1 shows a partially sectioned top view of an inventive liquid vacuuming device.

An inventive liquid vacuuming device is illustrated in FIG. 1. In this figure, the upper region is not illustrated in sectioned form, wherein the lower region is illustrated in sectioned form, but the illustration of the sectioned edges of the housing 1 was omitted in order to provide a better overview.

In its front region, the device features an extracting lip 7 that is able to draw off liquid from a surface. The classic application of this device is drawing off water from a window surface. A vacuum mouth 5 is arranged behind the extracting lip 7 and realized in the form of a broad nozzle in this case, wherein the width of the vacuum mouth essentially corresponds to the width of the extracting lip 7. The liquid/air mixture is vacuumed into a hollow chamber 2 through an intake channel 4, the hollow chamber 2 serving as a separation chamber with a separating device capable of separating the liquid from the air flow.

The further function of the device is described in greater detail below with reference to the sections illustrated in FIGS. 2 and 3, as well as the detail illustrated in FIG. 3:

A central tank-like component in the form of the hollow chamber 2 is provided in the housing 1. This hollow chamber 2 combines different functions of the liquid vacuuming device with one another. On the one hand, it forms the tank, in which the liquid separated from the liquid/air mixture can be collected. On the other hand, it also integrates the separation space, in which the separation of the air from the liquid takes place. The hollow chamber 2 ultimately also forms a protection against the escape of the separated liquid.

The exhaust air channel 3 and the intake channel 4 respectively protrude into the hollow chamber 2 with a pipe nozzle. These two channels are arranged concentric to one another and extend toward one another, wherein the separating device 13 is arranged between the ends of the two channels.

Figure 2:
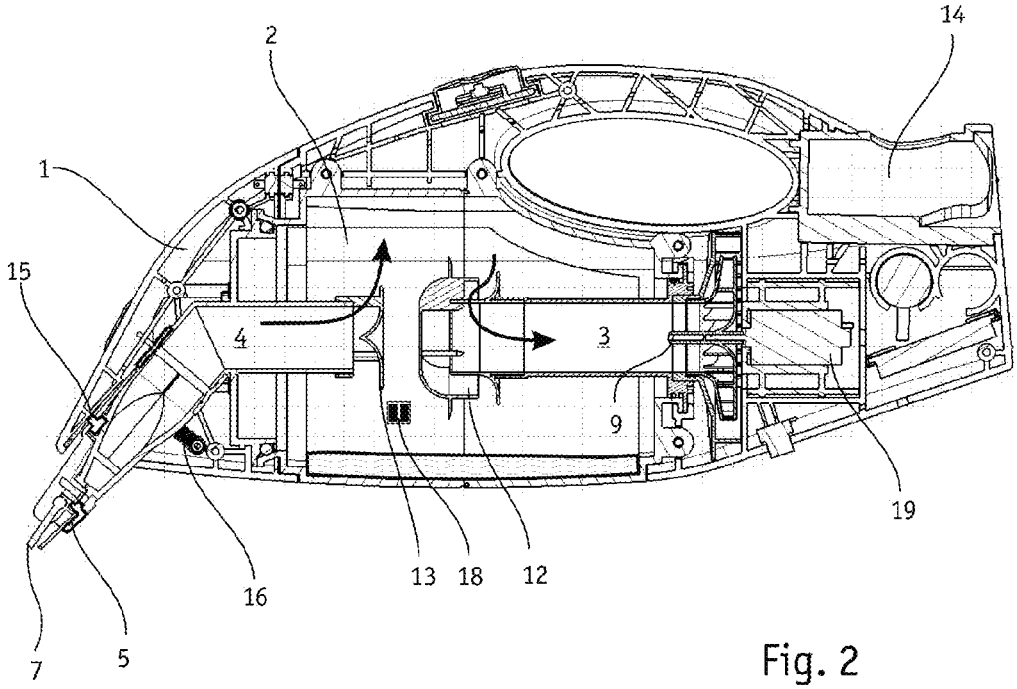
FIG. 2 shows a sectioned side view of the liquid vacuuming device illustrated in FIG. 1 with a first embodiment of the separating device.

FIG. 2 shows a first embodiment of the invention with a rigid separating device 13 that is realized in the form of a stator in this case and deflects the flow radially outward into the tank.

This embodiment has an on/off function that turns on the motorized drive 19 of the vacuum subassembly or increases the motor power when pressure is exerted upon the extracting lip 7 and turns off the motorized drive 19 or reduces the motor power when the pressure decreases. For this purpose, the vacuum nozzle is held in position by means of a lower return spring 16 and a switch in the form of a "T-shaped" sensor 15 is provided on top.

The exhaust air channel 3 protrudes into the tank in the rear region thereof. In order to prevent splash water from being admitted into the exhaust air channel 3, the exhaust air channel 3 realized in the form of a pipe nozzle is provided with a flow labyrinth 12 that forces the flow to reverse its direction twice as indicated with the schematic air flow arrow and thereby separates the air from residual water that remains in the tank.

Figure 3:
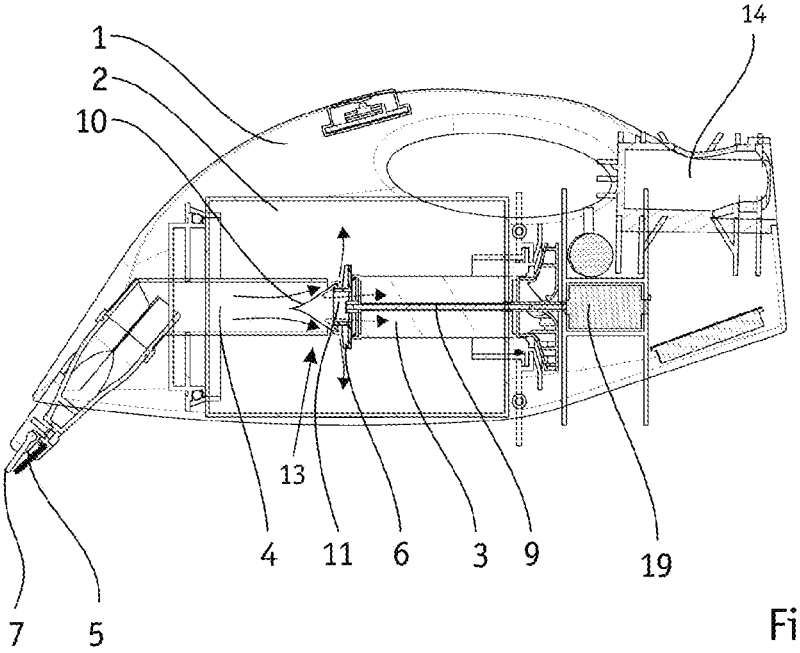
FIG. 3 shows a sectioned side view of the liquid vacuuming device illustrated in FIG. 1 with a second embodiment of the separating device.

In the embodiment illustrated in FIG. 3, a gap remains between the discharge channel 3 and the intake channel 4 and a rotor 6 is arranged in this gap. This rotor 6 is driven via a drive shaft 9, wherein the drive shaft 9 is arranged concentric to the exhaust air channel 3. The rotor 6 laterally protrudes beyond the exhaust air channel 3 and into the hollow chamber 2 with impact surfaces.

In its end region, the exhaust air channel 3 features a flow guiding profile 10 that is realized in the shape of an internally hollow truncated cone in this case. This truncated cone diverts the mixture of water and air taken in through the intake channel 4 outward such that it impinges on the outer region of the rotor 6 that forms the impact surface at this location. As a result, the liquid/air flow being taken in is accelerated in the radial direction, as well as in the circumferential direction of the rotor 6, wherein the more inert liquid describes a different trajectory than the lighter air.

According to FIG. 3, the motorized drive 19 and the vacuum subassembly are located in the rear region of the housing 1, in which the power supply in the form of a battery is also arranged. As a result, the center of gravity of the device is shifted toward the rear such that it can be very easily moved along a window pane or another surface in the upright position.

The extracting lip 7 is arranged in the front region and the vacuum mouth 5 is provided behind the extracting lip. From this location, the flow channel extends into the hollow chamber 2 via the intake channel 4.

Figure 4:
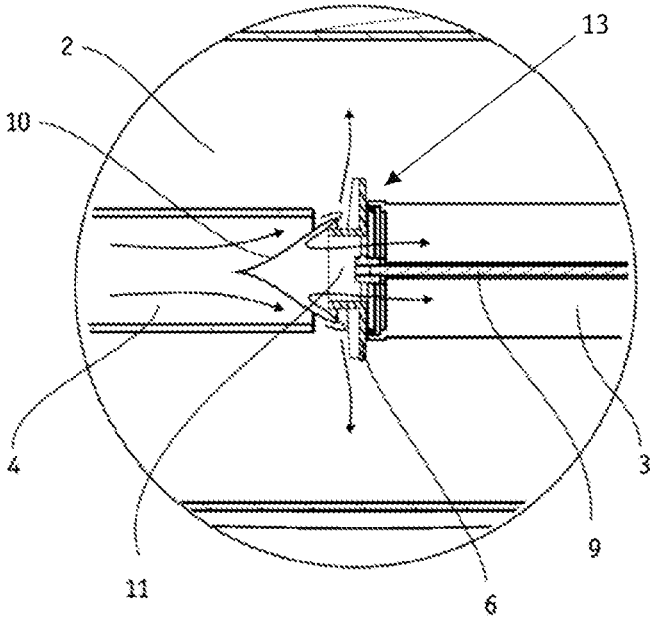
FIG. 4 shows an enlarged illustration of the region of the rotor of the liquid vacuuming device illustrated in FIG. 3.

FIG. 4 once again shows the region of the rotor 6 within the hollow chamber 2 in the form of an enlarged illustration. According to this figure, the rotor 6 protrudes into the flow guiding profile 10. For this purpose, it features an annular pipe nozzle that is directed forward from the rotor wheel 6 and projects in the direction of the intake channel 4.

Small gaps remain between this region of the rotor 6 and the flow guiding profile 10 such that the air to be vacuumed off produces a labyrinth seal in that it initially flows outward on the outer side of the flow guiding profile 10 along the inner arrows, is then drawn into the interior of the flow guiding profile 10 along a tight inward curve and ultimately drawn into the exhaust air channel 3 through the internally hollow rotor wheel 6. The more inert liquid cannot follow a trajectory with such a small curvature radius and therefore is conveyed outward radially and in the circumferential direction of the rotor wheel along the outer arrows. As a result, the liquid collects in the hollow chamber 2, particularly on the inner wall, and flows into the lower region of the hollow chamber 2, which then serves as a tank, when the device is in the upright position.

The illustrated embodiment of the liquid vacuuming device only represents one conceivable option for utilizing the basic principle of the invention. An important aspect of the invention is the fact that a separate separation chamber is no longer provided and that the liquid/air flow is directly diverted onto a rotor wheel 6, which due to its rotation utilizes the different dynamic inertias of the air and the liquid for separating both flows from one another. Furthermore, the rotor wheel 6 may be driven via a drive shaft 9 through the exhaust air channel 3 as shown, wherein the rotor wheel 6 alternatively may naturally also be driven by a separate drive.

A level sensor 18 may be provided in the hollow chamber 2, wherein said level sensor may be formed, for example, by an electric contact and turns off the motor once a certain liquid level is reached, beyond which it is no longer ensured that liquid can escape through the exhaust air channel 3 or the intake channel 4.

The battery arranged in the rear region of the device is preferably connected to the housing 1 in a detachable fashion such that it can be removed. Furthermore, the rear region of the housing 1 may feature a mounting option in the form of a receptacle socket 14 for a pole such that the device can also be used at greater heights.

Another advantageous embodiment features an extracting lip 7 in the form of an extractable rubber lip that is mounted, for example, on a holding rod protruding into the housing 1 such that it is arranged in front of the vacuum mouth 5. In this case, the holding rod may be realized in the form of a suction pipe and detachably inserted into the housing 1, wherein this provides the advantage that the user can remove the extracting lip 7 for smaller meticulous tasks that do not require a vacuuming effect and use the extracting lip as a lightweight extracting tool.

Figure 5:
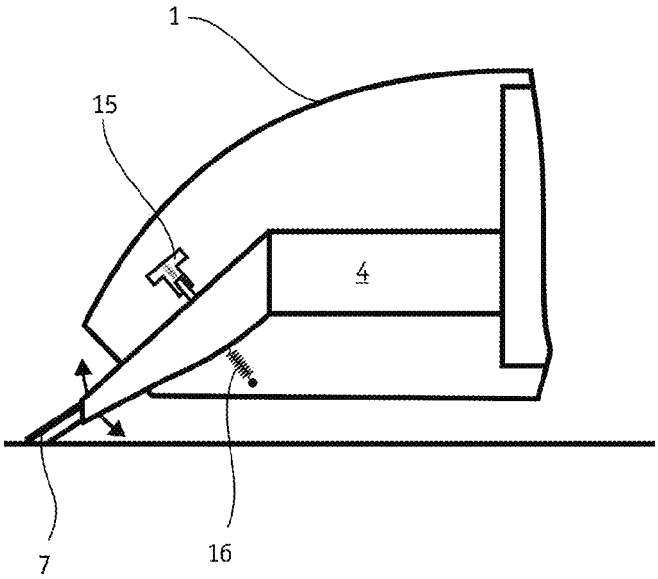
FIG. 5 shows a detailed illustration of switching arrangement shown in FIG. 2.

FIG. 5 shows a schematic detail of the switch formed by the sensor 15, the easily movable support of the vacuum mouth 5 and the return spring 16.

Figure 6:
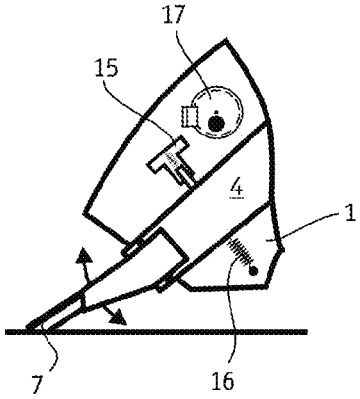
FIG. 6 shows a sub-assembly according to various embodiments.

FIG. 6 shows a subassembly that can be inserted into the intake channel and contains the vacuum mouth and the extracting lip. Furthermore, the device may be turned on/off, or suction power increased/reduced, as explained above, by means of an orientation switch 17.

Figure 7:
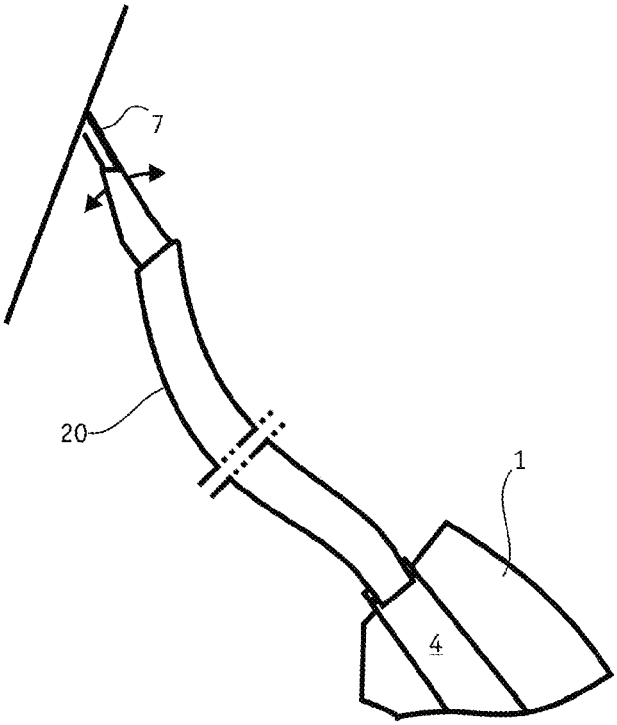
FIG. 7 shows a further arrangement according to an embodiment.

FIG. 7 shows the intermediate arrangement of a hose 20 between the subassembly illustrated in FIG. 6 and the housing. In this way, the heavy device can be held in the hand or placed on the ground while the lighter subassembly is used for drawing off liquid.

LIST OF REFERENCE SYMBOLS

1 Housing
2 Hollow chamber
3 Exhaust air channel
4 Intake channel
5 Vacuum mouth
6 Rotor
7 Extracting lip
9 Drive shaft
10 Flow guiding profile
11 Intake nozzle
12 Flow labyrinth
13 Separating device
14 Receptacle socket for attaching a pole
15 Sensor
16 Return spring
17 Orientation switch
18 Level sensor
19 Motorized drive
20 Hose

What is claimed is:

1. A liquid vacuuming device for drawing off and vacuuming up liquids, including:

a housing, an extractor device, including at least one extracting lip configured to extract and collect liquid in front of at least one vacuum mouth, a vacuuming device including a motor-driven vacuum subassembly and configured to vacuum an air/liquid flow that includes the liquid to be vacuumed up along a flow pathway from the vacuum mouth through an intake channel into the housing, a separating device configured to separate the liquid from the air, a tank configured to receive the separated liquid, an exhaust air channel configured to discharge the air from the housing, and a switch configured to turn on a motorized drive of the vacuum subassembly or to increase the motor power when pressure is exerted upon the extracting lip and to turn off the motorized drive or to reduce the motor power when the pressure decreases.

2. The liquid vacuuming device according to claim 1, wherein the switch comprises a pressure switch formed by a support of the extracting lip and a sensor, wherein the extracting lip is supported on the housing and is configured to be pivoted against the force of a return spring.

3. The liquid vacuuming device according to claim 1, further including a delay switch configured to delay the turning off of the motorized drive or the reduction of the motor power such that a brief pivoting motion of the liquid vacuuming device does not affect the function of the motorized drive.

4. The liquid vacuuming device according to claim 1, further including a timer configured to turn off or power down the motorized drive of the vacuum subassembly after a predetermined period of time.

5. The liquid vacuuming device according to claim 1, further including a level sensor disposed within the tank and configured to turn off the motorized drive when a certain level of the liquid is reached.

6. The liquid vacuuming device according to claim 1, wherein the separating device comprises a flow deflection arrangement in the form of a rotor on an air intake side that is arranged on the intake channel in front of an inlet of the air/liquid flow into the tank or in the tank, and which is configured to deflect the air/liquid flow being taken in radially outward into the tank, the device further including a flow labyrinth that is arranged in front of an inlet into the exhaust air channel.

7. The liquid vacuuming device according to claim 1, wherein the vacuum mouth is rotatably supported relative to the housing.

8. The liquid vacuuming device according to claim 1, wherein the housing includes a receptacle socket for a pole on a rear side that lies opposite the vacuum mouth.

9. The liquid vacuuming device according to claim 1, wherein the extracting lip and the vacuum mouth are realized in the form of a separate component configured to be inserted into the housing, and wherein the vacuum mouth is connected to the intake channel by means of a sealed plug-type pipe connection.

10. A liquid vacuuming device for drawing off and vacuuming up liquids, including:

a housing, an extractor device, including at least one extracting lip configured to extract and collect liquid in front of at least one vacuum mouth, a vacuuming device including a motor-driven vacuum subassembly and configured to vacuum an air/liquid flow including the liquid to be vacuumed up along a flow pathway from the vacuum mouth through an intake channel into the housing, a separating device configured to separate the liquid from the air, a tank configured to receive the separated liquid, an exhaust air channel configured to discharge the air from the housing, an orientation switch configured to realize an on/off function, wherein said orientation switch is configured to turn off or power down a motorized drive of the vacuum subassembly when the housing is tilted or pivoted out of an upright position, in which the extracting lip is arranged on top of the liquid vacuuming device when the liquid vacuuming device is in an upright position, or when the extracting lip points downward, and a delay switch configured to delay the turn-off function such that a brief pivoting motion of the liquid vacuuming device does not affect the function of the motorized drive.

11. The liquid vacuuming device according to claim 10, further including a timer configured to turn off or power down the motorized drive of the vacuum subassembly after a predetermined period of time.

12. The liquid vacuuming device according to claim 10, further including a level sensor disposed within the tank and configured to turn off the motorized drive when a certain level of the liquid is reached.

13. The liquid vacuuming device according to claim 10, wherein the separating device comprises a flow deflection arrangement in the form of a rotor on an air intake side that is arranged on the intake channel in front of an inlet of the air/liquid flow into the tank or in the tank, and which is configured to deflect the air/liquid flow being taken in radially outward into the tank, the device further including a flow labyrinth that is arranged in front of an inlet into the exhaust air channel.

14. The liquid vacuuming device according to claim 10, wherein the vacuum mouth is rotatably supported relative to the housing.

15. The liquid vacuuming device according to claim 10, wherein the housing includes a receptacle socket for a pole on a rear side that lies opposite the vacuum mouth.

16. The liquid vacuuming device according to claim 10, wherein the extracting lip and the vacuum mouth are realized in the form of a separate component configured to be inserted into the housing, and wherein the vacuum mouth is connected to the intake channel by means of a sealed plug-type pipe connection.

* * * * *